US007213683B2

(12) United States Patent
Lilie et al.

(10) Patent No.: US 7,213,683 B2
(45) Date of Patent: May 8, 2007

(54) PISTON LUBRICATING SYSTEM FOR A RECIPROCATING COMPRESSOR WITH A LINEAR MOTOR

(75) Inventors: Dietmar Erich Bernhard Lilie, Joinville (BR); Ingwald Vollrath, Joinville (BR); Egidio Berwanger, Joinville (BR); Rinaldo Puff, Joinville (BR)

(73) Assignee: Empresa Brasileira de Compressores S.A. Embraco, Joinville- SC (BR)

( * ) Notice: Subject to any disclaimer, the term of this patent is extended or adjusted under 35 U.S.C. 154(b) by 607 days.

(21) Appl. No.: 10/471,853

(22) PCT Filed: Mar. 12, 2002

(86) PCT No.: PCT/BR02/00040

§ 371 (c)(1),
(2), (4) Date: Nov. 11, 2003

(87) PCT Pub. No.: WO02/073034

PCT Pub. Date: Sep. 19, 2002

(65) Prior Publication Data

US 2004/0074700 A1 Apr. 22, 2004

(30) Foreign Application Priority Data

Mar. 13, 2001 (BR) ..... 0101017

(51) Int. Cl.
*F01M 1/00* (2006.01)

(52) U.S. Cl. ..... 184/6.16; 417/372

(58) Field of Classification Search ..... 184/6.16; 417/417, 372, 569

See application file for complete search history.

(56) References Cited

U.S. PATENT DOCUMENTS

| | | | | |
|---|---|---|---|---|
| 4,067,667 | A * | 1/1978 | White | 417/418 |
| 6,409,484 | B1 * | 6/2002 | Hyun | 417/417 |
| 6,742,998 | B2 * | 6/2004 | Kawahara et al. | 417/416 |
| 7,086,840 | B2 * | 8/2006 | Lilie | 417/211 |

FOREIGN PATENT DOCUMENTS

| | | |
|---|---|---|
| WO | WO-97/01032 A1 | 1/1997 |
| WO | WO-97/01033 A1 | 1/1997 |
| WO | WO 02/20990 A1 | 3/2002 |

* cited by examiner

*Primary Examiner*—David M. Fenstermacher
(74) *Attorney, Agent, or Firm*—Darby & Darby

(57) ABSTRACT

The present invention provides a piston lubrication system for a reciprocating compressor with a linear motor. The piston lubrication system includes an oil sump defined within a hermetic shell, and a cylinder affixed within the hermetic shell. A radial gap is defined by a piston located within the cylinder. A pump supplies oil from the oil sump to the radial gap via the oil supply duct and oil return duct.

10 Claims, 2 Drawing Sheets

PISTON LUBRICATING SYSTEM FOR A RECIPROCATING COMPRESSOR WITH A LINEAR MOTOR

CROSS-REFERENCE TO RELATED APPLICATIONS

This application is a U.S. national phase application under 35 U.S.C. §371 of International Application No. PCT/BR02/000040 filed Mar. 12, 2002, and claims the benefit of Brazilian Patent Application No. PI0101017-4 filed Mar. 13, 2001 which is incorporated by reference herein in its entirety.

FIELD OF THE INVENTION

The present invention refers, in general, to a piston lubrication system for a reciprocating compressor of the type driven by a linear motor and used in small refrigeration appliances, such as refrigerators, freezers, water fountains, etc. and, more particularly, to the lubrication system of a piston with a vertical shaft for the type of reciprocating compressor mentioned above.

BACKGROUND OF THE INVENTION

In a compressor of the type driven by a linear motor, the gas compression and gas suction operations are performed by the axial movement of a piston inside a cylinder, which is closed by a cylinder head and mounted inside a hermetic shell, in the cylinder head being positioned a discharge valve and a suction valve, which control the admission and discharge of gas in the cylinder. The piston is driven by an actuating means that carries magnetic components such as an electrical coil, which is exposed to a magnetic field generated by a magnetic element, such as a magnet, and operatively associated with a linear motor affixed to the shell of the compressor.

These constructions generally present two helical springs under constant compression and which are operatively mounted against the actuating means, each seated against an adjacent surface of the latter. The piston, the movable parts of the actuating means, the magnetic components, and the helical springs form together the resonant assembly of the compressor, which is driven by the linear motor and has the function to develop a reciprocating linear movement, making the movement of the piston inside the cylinder exert a compression action on the gas admitted by the suction valve, until a point is reached in which said gas is discharged to the high pressure side, through the discharge valve.

The reciprocating movement of the piston requires a lubrication system to minimize frictions and wears, in order to assure an adequate performance to the compressor.

In constructions known from the art, the supply of lubricant oil to the cylinder and piston is made through a lubrication system using the principle of centrifugal force and mechanical drag, with channels contained in the cylinder, such as presented in document PI0004286-2, of the same applicant, or in documents WO97/01032 and WO97/01033. These channels are of complex construction, due to the difficult access to the lubricated region and require careful sealing, since they pass through some components.

In one of the known solutions, in order to supply oil to the piston/cylinder assembly, it is necessary to make the compressor suction gas flow, which generates a small pressure differential in relation to the oil sump, to draw said oil through a capillary tube, mixing it with the gas drawn by the compressor, said mixture being admitted to the inside of the cylinder by the suction valve, so that the oil lubricates the contact regions between the piston and the cylinder. As a function of the low gas flow drawn by the compressor in certain situations, this construction presents low efficiency regarding lubrication.

In another known construction (WO97/01033), the compression and suction forces of the piston are used to displace the lubricant oil from the sump, through a capillary tube, to an upper reservoir formed around the cylinder, said upper reservoir being connected to the inside of the cylinder by a plurality of orifices formed in the wall of the latter and which serve for admitting oil into the piston-cylinder gap, when the piston is performing the suction movement, and for discharging said oil when the piston is performing the reverse movement. The oil is discharged into a number of channels formed in the valve plate of the compressor, further supplying the suction flow, causing said oil to re-enter the cylinder.

Other known solution (WO97/01032) uses a resonant mass that moves reciprocally inside a cavity formed in the external side of the cylinder, said resonant mass drawing oil from the sump while moving in one direction, said oil passing through a tube and through a check valve, which allows only the admission of oil into said cavity, the latter being connected to the inside of the cylinder by a plurality of orifices formed in the wall thereof. The oil in said cavity is expelled when the resonant mass moves in the other direction and passes through a check valve, which allows only the discharge of oil from said cavity. Although being functional, this solution is difficult to manufacture and its construction presents many components.

OBJECTS OF THE INVENTION

It is an object of the present invention to provide a piston lubrication system for a reciprocating compressor, of simple construction, which results in a continuous and adequate lubrication of the piston and cylinder, allowing said lubrication to be obtained without the provision of channels for conducting oil through the cylinder.

It is another object of the present invention to provide a piston lubrication system for a reciprocating compressor, which, besides the characteristics mentioned above, allows lubrication to be achieved with minimum pressurization in the region between the external sidewall of the piston and the internal sidewall of the cylinder.

This and other objects are attained through a piston lubrication system for a reciprocating compressor with a linear motor, of the type comprising: a hermetic shell, defining therewithin an oil sump and affixing a cylinder, inside which is lodged a reciprocating piston presenting a top region and a body region defining a radial gap with the cylinder; and a pump means supplying lubricant oil from the oil sump to the radial gap, said system comprising: at least one oil supply duct having a lower end coupled to the pump means, and an upper end carried by the piston and opened to the radial gap; and at least one oil return duct carried by the piston and having an end opened to the radial gap, and an opposite end opened to the oil sump.

BRIEF DESCRIPTION OF THE DRAWINGS

The invention will be described below, with reference to the attached drawings, in which.

DESCRIPTION OF THE ILLUSTRATED EMBODIMENT

Figure 1:
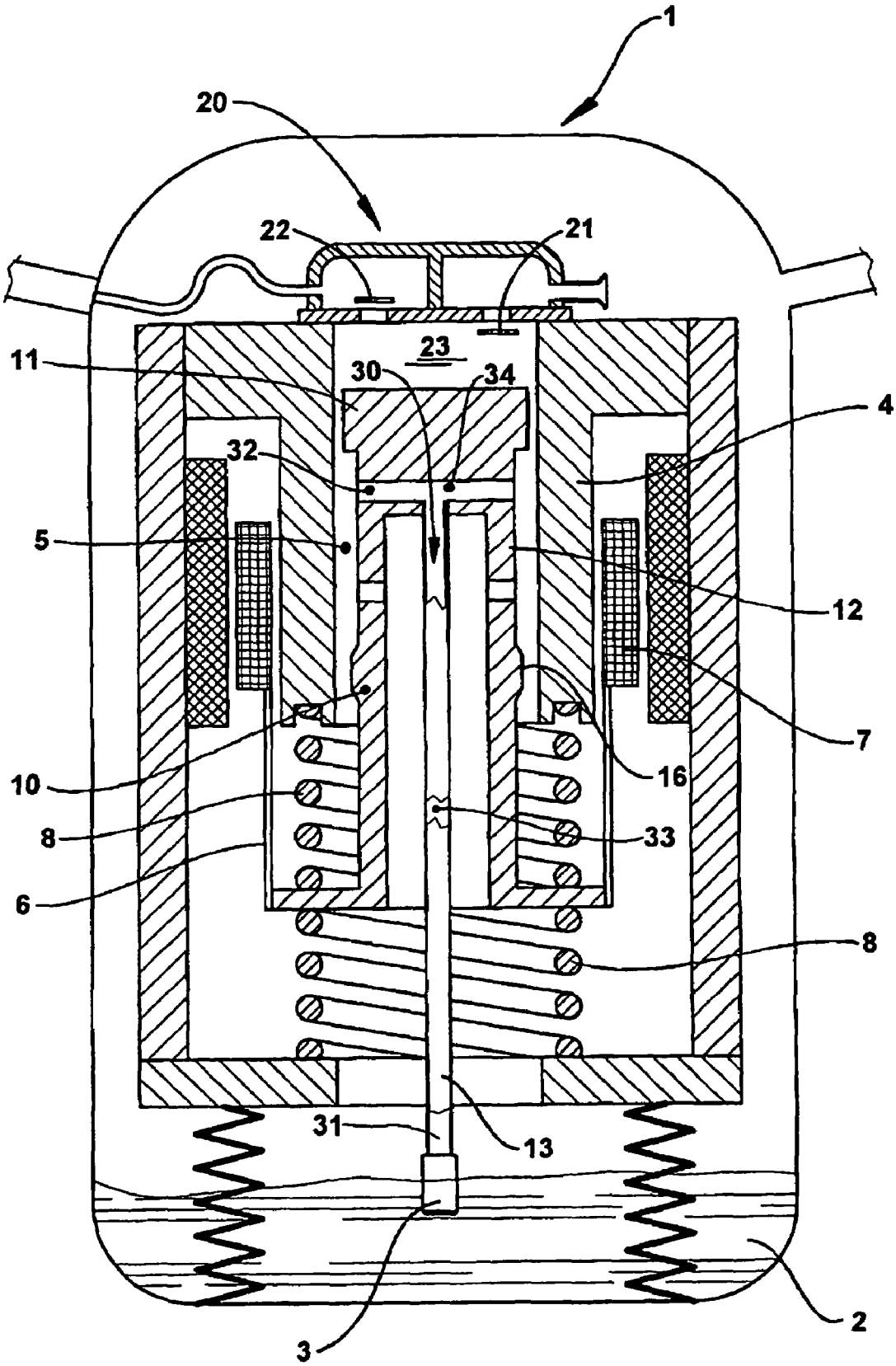
FIG. 1 is a schematic longitudinal diametrical sectional view of a hermetic compressor of the reciprocating type driven by a linear motor, in which the lubrication of the piston is made according to the present invention.
Figure 2:
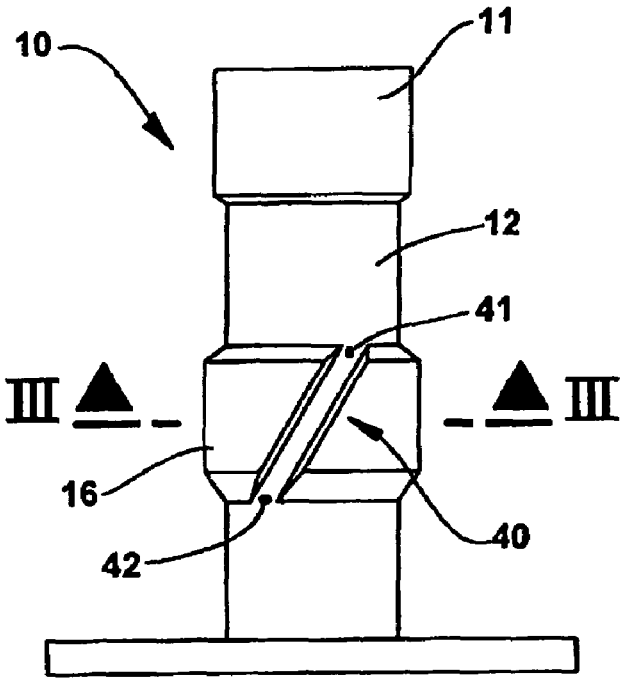
FIG. 2 is a schematic lateral view of the piston of the present invention, constructed according to a way of carrying out the invention.
Figure 3:
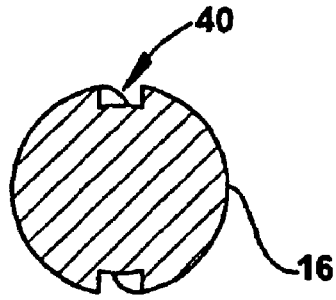
FIG. 3 is a schematic diametrical cross-sectional view of the piston illustrated in FIG. 2, according to line III—III in said figure.
Figure 4:
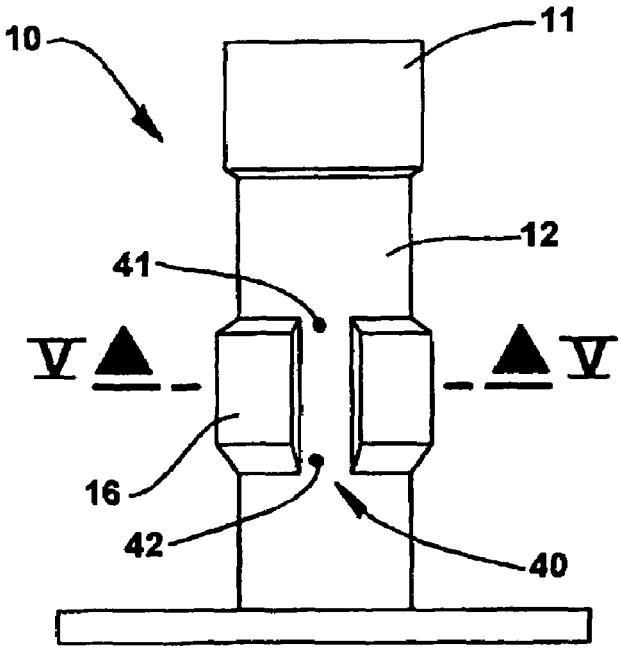
FIG. 4 is a schematic lateral view of the piston of the present invention, constructed according to another way of carrying out the invention.
Figure 5:
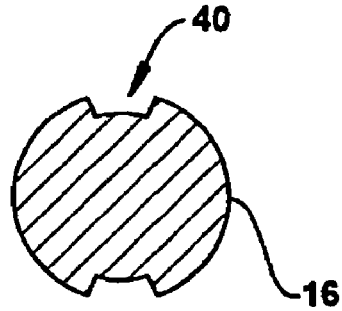
FIG. 5 is a schematic diametrical cross-sectional view of the piston illustrated in FIG. 4, according to line IV—IV in said figure.

The present invention describes a piston lubrication system for a reciprocating compressor with a linear motor (of the type applied to a refrigeration system), presenting a hermetic shell 1, defining in the interior thereof an oil sump 2, wherefrom the lubricant oil is pumped through a pump means 3, for example, a pump of the type described in Patent Application PI0004286-2, from the same applicant, to the inside of a cylinder 4, which is affixed inside the shell 1 and lodges a reciprocating piston 10. The illustrated piston 10 is of the tubular type, and presents a top region 11 and a body region 12 defining a radial gap 5 with the cylinder 4, said pump means 3 supplying lubricant oil from the oil sump 2 to said radial gap 5.

Cylinder 4 is closed by a cylinder head 20, where are positioned a suction valve 21 and a discharge valve 22, which control the admission and discharge of gas in the cylinder 4. Between the top region 11 of the piston 10 and the cylinder head is defined a compression chamber 23.

In the illustrated embodiment, the region of the radial gap 5 is defined by a diametrical reduction, which is provided along part of the axial extension of the piston 10 inferiorly to the top region 10 thereof. In the reciprocating hermetic compressor with a linear motor, the reciprocating movement of the piston 10 is made through an actuator 6, which sustains a magnetic component 7 driven by the linear motor. The piston 10 is connected to a spring means 8, which is formed for example, by a pair of helical springs under constant compression against the actuator 6, the piston 10 forming together with the magnetic component, the resonant assembly of the compressor. The non-resonant assembly of the compressor comprises the cylinder 4, a suction-discharge system of the compressor, and its linear motor.

According to the present invention, the oil pumped by the pump means 3 reaches the radial gap 5 through at least one oil supply duct 30, to be described ahead, which has a lower end 31, coupled to the pump means 3, and an upper end 32, which is carried by the piston 10 and opened to the radial gap 5, said oil returning to the oil sump 2, by at least one oil return duct 40, to be described ahead, which is carried by the piston 10 and has an inlet end 41 opened to the radial gap 5, and an outlet end 42 opened to the oil sump 2.

In a constructive option to be described below, at least one of the parts of the oil supply duct 30 and the oil return duct 30 presents part of its extension internal to the piston 10.

According to the present invention, the oil supply duct 30 comprises at least one supply axial portion 33 and at least one supply radial portion 34, which are defined inside the piston 10, each said supply axial portion 33 being in fluid communication with the oil sump 2 and with at least one supply radial portion 34, each supply radial portion 34 being opened to the lateral surface of the piston 10 in the region of the radial gap 5.

In the construction illustrated in FIG. 1, the supply axial portion 33 of the oil supply duct 30 is defined inside a tubular piston rod 13, which is coupled by a lower end to the pump means 3 and has an upper end opened to a plurality of supply radial portions 34, for example in the form of radial channels, which are substantially rectilinear and orthogonal to the axis of piston 10, and produced in the body region 12 of the piston 10, inferiorly to the top region 11 thereof.

According to a constructive form of the present invention, the oil return duct 40 is defined for example by a plurality of radial bores, generally rectilinear and orthogonal to the axis of piston 10 and which are produced in the sidewall of said piston 10, inferiorly to the supply radial portions 34 thereof.

In the constructive option illustrated in FIG. 1, the lubricant oil reaching the inlet end 41 of the oil return duct 40 arrives to the oil sump 2, flowing down along the internal lateral surface of said piston 10, and the oil may be conducted by one or more internal grooves (not illustrated).

In another constructive option of the present invention, the lubricant oil reaches the oil sump 2 through an oil return duct 40 defined by a groove, which is produced in the external lateral surface of the piston 10, or by an axial channel produced along part of the axial extension of said piston 10 (the latter being solid), opened to the oil sump 2.

In the construction illustrated in FIGS. 2–5, the piston lubrication system also presents another oil return duct 40, which conducts the oil existing in the radial gap 5 to the oil sump 2 by the external lateral surface of the piston 10. In this construction, the piston 10 presents a bearing ring 16, which is defined by a diametrical enlargement in a portion of its extension, inferior to that presenting a diametrical reduction and which defines the radial gap 5, said bearing ring 16 presenting at least one oil return duct 40, for example in the form of an axial or helically developed groove produced along the extension of said bearing ring 16.

In the construction of the piston 10 of the present invention, the latter has, according to the illustrations, two functional regions: the piston top region 11, which operates with the oscillation of the piston 10, and the bearing ring 16, which works as a sealing means, for better sealing the compression chamber 23, as a bearing means, and as a guiding means, absorbing the radial efforts on the piston 10 and generating minimum viscous friction.

The piston top region 11 presents narrow gaps, which substantially isolate the region of the radial gap 5 from the compression chamber 23.

The bearing ring 16 is provided in a certain position of the axial extension of the piston 10, which position is calculated in order to minimize the effect of moments during operation of the compressor.

With the construction of the present invention, the lubricant oil, which is pumped to the radial gap 5, is contained in this region and returns to the oil sump 2 through the oil return duct. Part of this oil returns to said oil sump 2 through each oil return duct 40 produced through the bearing ring 16. Besides actuating in the oil return, the oil return duct 40 provided on the external lateral surface of the piston 10 also provides a pressure relief.

The invention claimed is:

1. A piston lubrication system for a reciprocating compressor with a linear motor, the piston lubrication system comprising:

a hermetic shell;

an oil sump defined within the hermetic shell;

a cylinder affixed within the hermetic shell;

a reciprocating piston disposed in the cylinder, the piston comprising:

a top region; and a body region;

a radial gap defined by the top region and the body region of the piston and the cylinder;

a pump supplying lubricant oil from the oil sump to the radial gap, the pump comprising:

at least one oil supply duct comprising:

a lower end coupled to the pump; and an upper end carried by the piston and opened to the radial gap;

at least one oil return duct carried by the piston, the at least one oil return duct comprising:

an inlet end opened to the radial gap; and an outlet end opened to the oil sump.

2. The piston lubrication system according to claim 1, wherein at least one of the oil supply duct and the oil return duct comprises a portion that is internal to the piston.

3. The piston lubrication system according to claim 2, wherein the oil supply duct comprises:

at least one supply axial portion; and at least one supply radial portion, wherein the at least one supply axial portion is in fluid communication with the oil sump at least one supply radial portion, and the at least one supply radial portion is opened to a lateral surface of the piston in the region of the radial gap.

4. The piston lubrication system according to claim 3, wherein

The oil supply duct has the at least one supply axial portion defined inside a piston rod, and the piston rod is affixed by a lower end to the pump and has an upper end opened to at least one supply radial portion produced in the body region of the piston inferior to the top region of the piston.

5. The piston lubrication system according to claim 1, wherein the oil return duct comprises a radial bore produced in the a side wall of the piston.

6. The piston lubrication system according to claim 1, wherein the region of the radial gap is defined by a diametrical reduction provided along a part of an extension of the piston.

7. The piston lubrication system according to claim 6 wherein the piston comprises a bearing ring defined by a diametrical enlargement in a portion of an extension inferior to that presenting a diametrical reduction of the piston.

8. The piston lubrication system according to claim 7, wherein the bearing ring comprises at least one oil return duct produced in an external lateral surface of the piston.

9. The piston lubrication system according to claim 8, wherein the at least one oil return duct produced in the external lateral surface of the piston is rectilinear.

10. The piston lubrication system according to claim 8, wherein the at least one oil return duct produced in the bearing ring is in the shape of a helical groove.

* * * * *